United States Patent [19]

Windsor et al.

[11] Patent Number: 4,742,670

[45] Date of Patent: May 10, 1988

[54] CARTON OVER PRODUCT PACKAGING APPARATUS

[76] Inventors: Robert N. Windsor, 8 Sharon Crescent, Mountain Creek Estate, Mooloolaba, Queensland; Maxwell C. Dowzer, 32 Maggs Street, Wavell Heights, Queensland, both of Australia

[21] Appl. No.: 33,130

[22] Filed: Apr. 1, 1987

[30] Foreign Application Priority Data

Apr. 2, 1986 [AU] Australia ..... PH 5283

[51] Int. Cl.[4] ..... B65B 43/18; B65B 35/30; B65B 7/20

[52] U.S. Cl. ..... 53/543; 53/564; 53/242; 53/374

[58] Field of Search ..... 53/543, 566, 564, 374, 53/242

[56] References Cited

U.S. PATENT DOCUMENTS

| | | | |
|---|---|---|---|
| 3,445,980 | 5/1969 | Salomon | 53/542 X |
| 3,605,377 | 2/1970 | Sabel | 53/564 X |
| 3,626,661 | 12/1971 | Reichert et al. | 53/564 X |
| 3,842,571 | 10/1974 | Focke et al. | 53/374 X |
| 4,018,143 | 4/1977 | Dice, Jr. et al. | 53/564 X |
| 4,196,563 | 4/1980 | Gabrielson et al. | 53/374 X |
| 4,515,581 | 5/1985 | Molitor et al. | 53/564 X |
| 4,674,261 | 6/1987 | Sabel | 53/564 X |

*Primary Examiner*—Horace M. Culver

*Attorney, Agent, or Firm*—Nilsson, Robbins, Dalgarn, Berliner, Carson & Wurst

[57] ABSTRACT

A carton over product packaging apparatus including infeed means for conveying a plurality of containers to be packaged to a collating zone in which the containers are collated into a plurality of rows, container indexing means for moving the containers in the collating zone from that zone to a packaging zone.

30 Claims, 8 Drawing Sheets

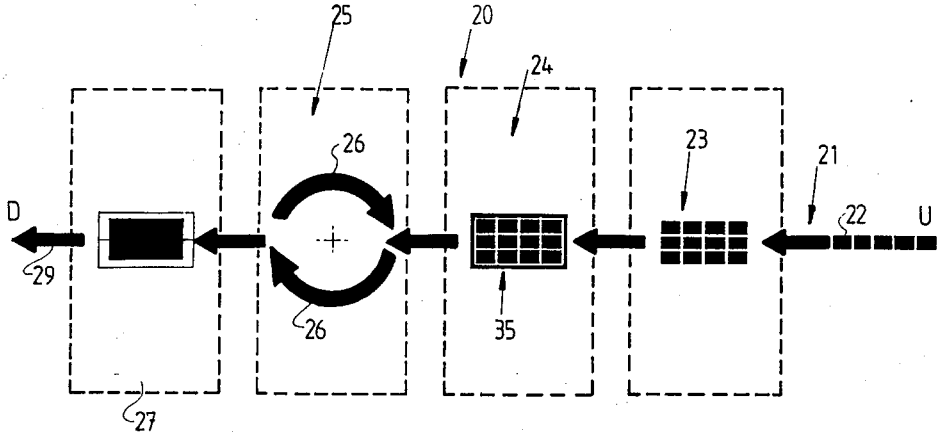
FIG. 1.
FIG. 2.
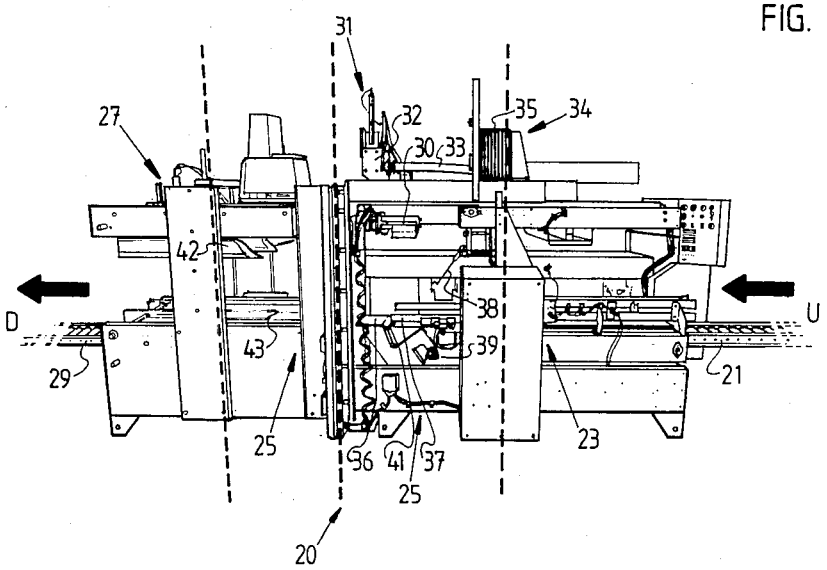

CARTON OVER PRODUCT PACKAGING APPARATUS

The present invention relates to a packaging apparatus for placing a plurality of containers in a carton. In particular, the invention relates to a carton over product (COP) packing apparatus.

In known COP apparatus a plurality of containers such as bottles, cans or Tetra bricks were fed to the apparatus by feed means along one direction, caused to move in a second direction and collated into plural rows and columns. An operator was necessary to erect a carton (usually a slotted carton) and to position the carton vertically over the collated containers. Thereafter the carton was transported along the first direction but laterally spaced from the direction of travel of the feed means to a carton flap closing station and then to a carton sealer.

The apparatus required an operator for erecting the carton and for placing it over the containers and therefore was not automatic. The construction of the apparatus was such that the changes in direction as the containers moved into the apparatus and as the carton with containers within it was moved to the flap closing station considerable floor space were necessary. This required a staggered flow of containers through the apparatus and the feed means was either located to the left or right of the apparatus. A right hand version of the apparatus was not suitable for all factory floor layouts and thus two models—a left hand and a right hand, were required. Because of the staggered nature of the flow both of these versions of the apparatus took up relatively large areas of floor space and could not readily be used in new locations in the factory without considerable change to floor layout of the factory.

It is an object of the invention to provide a packaging apparatus which at least minimises the disadvantages referred to above.

According to one aspect of the invention there is provided a carton over product packaging apparatus including infeed means for conveying a plurality of containers to be packaged to a collating zone in which the containers are collated into a plurality of rows, container indexing means for moving the containers in the collating zone from that zone to a packing zone, a carton erector longitudinally reciprocably movable and adjacent and above the packing zone, said erector removing a carton from a carton supply station and erecting the carton, positioning means vertically reciprocably movable for receiving a carton from said erector and placing it over containers located in the packing zone, carton closure means downstream of the packing zone and including a turntable for receiving cartons from the packing zone and for rotating them through 180 degrees, said closure means including flap closure ploughs for closing top and bottom closure flaps of the carton, said containers progressing longitudinally through the apparatus from an upstream to a downstream end thereof.

The apparatus is particularly suitable for use with slotted cartons. Whilst the apparatus of the invention may be used with other types of cartons, the operation of the apparatus of the invention will be described by way of example with reference to slotted cartons. Such cartons have four main body panels with depending top and bottom closure flaps. Slotted containers of this type are usually supplied with the main panels folded flat against each other and need to be erected into a square or rectangular open carton during the packaging operation. The closure flaps which comprise major and minor flaps extend outwardly from opposite ends of the main panels and each main panel has two flaps extending therefrom and planar therewith.

The infeed means may include an infeed conveyor. The conveyor extends from an upstream end of the apparatus to a location downstream of that end. Preferably the conveyor transports a single line of containers into the apparatus although a plurality of lines or rows of containers may be transported if desired. The conveyor may be a roller, belt or chain conveyor. Preferably a chain-like conveyor is employed having segments linked together to form a continuous conveyor loop. The chain conveyor may pass over a suitable shaft, guides, rollers or sprockets. Preferably a plurality of sprockets mounted on a shaft are located at spaced intervals and the chain-like conveyor passes over them. The conveyor may be driven in any suitable way. For example a drive motor may be coupled to one of the shafts. Ideally a gear box is positioned between the motor and the shaft and drives the shaft.

The collating zone assembles together a plurality of rows of containers. The zone may include partitions extending along and above the conveyor for this purpose but it is preferred that partitions be omitted. Where containers are supplied in a single line or row by the conveyor the collating zone may include a divertor for selectively directing containers to desired locations at the zone to set up the plurality of rows of containers. For example three, four or more rows of containers with each row having four containers in it may be collated in this zone. A sensor may be associated with the apparatus and in particular with the divertor and the infeed conveyor to count the number of containers whereby the flow of further containers by the in feed conveyor after a predetermined container count has been reached may be inhibited and restarted after a predetermined elapsed period of time. The collating zone may include a stop member normally inhibiting the exit of containers from the zone until the desired number of rows have been established. The stop member extends across a container flow path through the apparatus and downstream of the collating zone. The stop member is transversely movable relative to the flow path from this inhibiting position to a position permitting the further movement of the containers towards the downstream end of the apparatus. Preferably the stop member is transversely movable between a position where it extends across the flow path and to a transverse position relative to the path where it does not impede movement of the containers. The stop member may comprise a stop arm. The stop arm is preferably mounted on a slide to enable the transverse movement.

The indexing means functions to move a plurality of rows of containers downstream of the collating zone to the packing zone. The indexing means is movable from an operative position across the flow path of containers through the apparatus. When the indexing means is in its operative position the stop arm is in its laterally displaced position away from in front of the downstream end of the collating zone.

When the indexing means is in an inoperative position the stop member is directed across the flow path of the containers and rows may be collated in the collating zone in its position downstream of the partitions. Thus the movement of the stop member and indexing means are linked. The indexing means may comprise two or more parallel arms movable transversely and longitudinally of the apparatus.

The carton erector of the invention is capable of removing individual cartons from a supply of cartons and erecting these cartons from a flat state to an erected state in which the carton appears substantially square or rectangular with the main body panels substantially vertically aligned and the top and bottom closure flaps extending outwardly from and co-planar with the main body panels. The carton erector may be located adjacent and above the flow path of containers through the apparatus. More preferably, both the carton erector and the supply of cartons are located adjacent and above the apparatus and thus vertically spaced from the conveyor upon which the containers may travel through the apparatus. It is preferred that the supply of cartons is located upstream of the carton erector. In this way the carton erector may withdraw a carton from the downstream end of the supply of cartons by moving towards the supply and away from the supply in a longitudinal direction along the apparatus. The carton erector preferably includes means for grasping a carton and withdrawing it from the supply. A deflecting plough may be arranged adjacent the grasping means such that when a carton is withdrawn from the supply, the carton may bear against the plough and be erected as the carton erector moves towards the downstream end of the apparatus. Preferably the carton erector includes a suction cap for engaging with a carton.

The carton positioning means of the apparatus of the invention is adapted to receive a carton from the erector after that carton has been erected. The carton positioning means is adapted to remove the carton from the erector and place it upon and over the rows of containers indexed or moved to the packing zone by the indexing arms. The movement of the carton positioning means is synchronized with the movement of the indexing means and preferably with the stop member of the collating zone. In this way, when a carton is positioned over containers in the packing zone further rows of containers cannot be indexed towards that zone by the indexing means. This synchronism may be achieved by having a common drive to achieve the movement of the carton positioning means and the indexing means or in some other suitable manner.

A single drive means may be used to ensure that the indexing means and the stop arm move in the manner described above. The drive means is linked to the indexing means to cause the movement described above.

The carton positioning means of the invention is preferably capable of moving from a location above the flow path of the containers, to a location below the flow path, back to the location above the flow path where it may receive a carton erected by the carton erector. The carton positioning means may be adapted to move on guide rails or tracks in the manner referred to above. The carton positioning means is preferably adapted to grasp a pair of bottom closure flaps of the carton. In one embodiment the carton positioning means includes two spaced pairs of fingers between each pair of which a bottom closure flap of the carton may be grasped. The carton positioning means may move a carton held between the fingers to a position over the packing zone and once the carton positioning means has moved vertically down over the containers in that zone the fingers may release the closure flaps. Once the carton positioning means achieves this it may return to its position above the flow path of containers. Further indexing of assembled rows of containers by the indexing arms causes the filled carton in the packing zone to be moved downstream of the apparatus.

The further downstream movement of the filled carton may cause the leading minor bottom closure flap to be folded towards its closed position. The trailing bottom closure flap may be caused to extend substantially horizontally directed towards the upstream end of the apparatus.

The apparatus of the invention further includes carton bottom flap closure means. This means is located downstream of the carton positioning means. The closure means preferably includes means for rotating a carton positioned upon it through 180 degrees. The closure means may include a closing plough adapted to partially close the trailing bottom minor closure flap when the carton is rotated. Preferably the closure means includes side guide means against which the bottom major closure flaps may bear during rotation of the carton whereby these flaps may be closed during rotation of the carton. The closure means for the bottom closure flaps may further include flap engaging ploughs, whereby, as the carton is moved past these ploughs the major bottom closure flaps may be folded against the bottom of the carton.

It is preferred that the bottom flap closure means be movable in a reciprocable manner along a longitudinal direction of the apparatus whereby the means may be moved downstream of the apparatus to provide any necessary clearance for movement of the carton positioning means. Thus, the closure means may be movable between an upstream position where it receives a carton and a downstream position at which rotation of the carton is effected to thereby close the bottom closure flaps. It is preferred that the closure means includes a turntable having a support surface upon which a carton may rest. The turntable may have a shaft rotatably mounted relative to a slide mounted for reciprocable longitudinal movement as referred to above. Whilst the turntable may be rotated in any convenient manner it is preferred that the shaft have a pinion secured thereto and the pinion be driven for rotating the turntable through 180 degrees to thereby also rotate the carton which rests upon the support surface through 180 degrees. It is preferred that the carton be held during rotation of the turntable. In one embodiment, the turntable includes clamps which may act against the major bottom closure flaps to hold them during rotation of the carton.

The apparatus of the invention may include transport means for moving the carton downstream from the support surface after the carton has been rotated through 180 degrees and the bottom closure flaps have been closed. The transport means may include a conveyor. Preferably the conveyor comprises a plurality of flight bars arranged extending between two transversely spaced chains. These chains may be driven over a set of four sprockets or guides arranged at both sides of the apparatus.

The apparatus may further include closure means for closing the top closure flaps. The leading top minor flap may be moved to its closed position as the carton is indexed from the packing zone on to the support surface of the carton bottom flap closure means. Similarly, the remaining top minor closure flap may be moved to its closed position by a closing lever arranged downstream of and above the bottom flap closure means such that when the carton is transported downstream from this means the remaining top minor flap is closed. Further flap closure means may be located downstream of the apparatus such that when the carton is transported past these means the two top major closure flaps may be moved to their closed positions. These flap closure means may comprise two transversely spaced flap closing ploughs.

The invention will be described by way of example with reference to the drawings in which:

FIG. 1 is a schematic plan view of an apparatus according to an embodiment of the invention;

FIG. 2 is a side elevational view of the apparatus of an embodiment of the invention;

Figure 3:
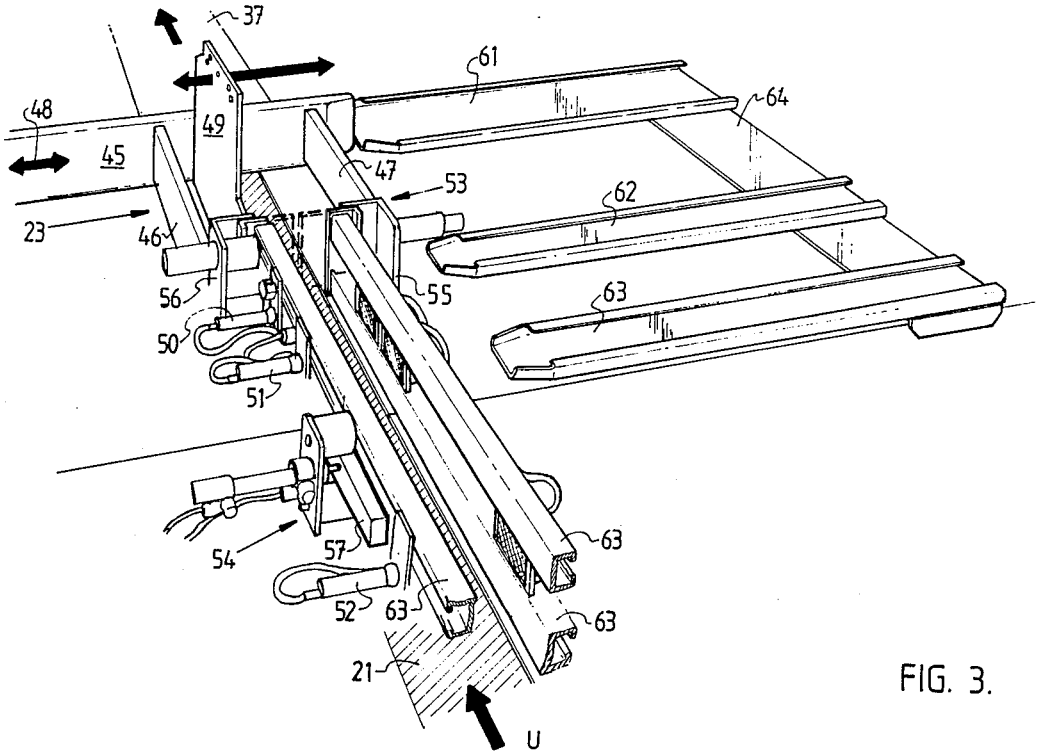
FIG. 3 is a partial perspective view of infeed means of the apparatus of FIG. 2 with some parts removed for the sake of clarity.

As shown in FIG. 1 the apparatus 20 includes an infeed means 21 along which a plurality of containers 22 are fed in a line to a collating zone 23. In zone 23 containers 22 are collated into a desired number of rows (in this case three rows are shown). Downstream of zone 23 there is a packing zone 24 in which a carton 35 is placed over the collated containers conveyed or indexed into that zone. Downstream of zone 24 there is provided a top and bottom flap closure station 25 at which the closure flaps are folded flat against the carton. In station 25 the carton with containers 22 within it is rotated through 180 degrees as shown diagrammatically by arrows 26. This rotation is an important part of the flap closure operation which will be described later. A flap glueing station 27 is located downstream of station 25. An outfeed means is shown diagrammatically by arrow 29.

FIG. 2 is a side elevational view of an apparatus 20 according to an embodiment of the invention. Infeed means 21 consists of a chain conveyor located at an upstream end U of the apparatus 20 and extend to an upstream end of collating zone 23. A carton positioning means including carton grippers 30 is located in zone 25. The grippers form part of the carton positioning means and are vertically reciprocably movable in zone 25 located above the grippers is a carton erector 31 consisting of a gripper head 32 and an arcuate plough member 33 which is spaced laterally further from the flow path of containers through the apparatus at its upstream end that at its downstream end. A carton supply 34 in which a plurality of collapsed cartons 35 is positioned above the flow path of containers and upstream of the erector 31. Erector 31 is adapted to move towards supply 34 and return to the position shown in this figure and then downwardly towards grippers 30. The grippers 30 may then grasp the major bottom closure flaps of a carton and position it over containers located in packing zone 25. Cartons are erected as they are drawn past plough 33. The leading minor flap of the carton is caused to project vertically downwardly between auxillary table 36 and packing table 37. The trailing minor bottom flap is caught on outwardly biased lever 38 to ensure that that flap extends horizontally on the packing table and is directed towards the upstream end U.

Figure 9:
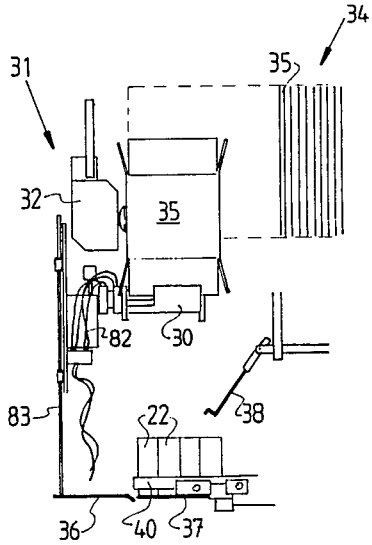
FIG. 9 is a view useful in understanding the operation of the positioning means.

With a carton in this position over collated containers in the packing zone a fold line between bottom closure flaps and main side panels of the carton is held level with the level of the packing table by transversely spaced pusher members 40 (see FIG. 9). These members are transversely reciprocably movable to first reposition containers in a tight formation of rows by pushing the containers transversely towards one another and then move apart slightly to enable grippers 30 to position the carton between them and the collated containers in the packing zone. The members 40 then move together to press the carton against the containers whilst the carton (with the containers within it) is transported downstream towards zone 25. Table 36 is pivoted at pivot 39 to enable grippers 30 to move below the level of packing table 37. Once a carton has been positioned in this way table 36 is returned to the position shown and the leading minor flap of the carton extends downwardly through the gap between table 36 and 37. As the carton is moved downstream this leading flap is closed as it strikes inclined leading edge 41 of table 36. At that stage members 40 may be released. Thus members 40 serve not only to tighten the container formation but to prevent the carton from dropping below that desired level relative to the table 37.

Grippers 30 are vertically reciprocably driven to first receive a carton from erector 34 and to position the carton over containers in the packing zone.

In zone 25 top and bottom closure ploughs 42, 43 are positioned for closing the top and bottom major flaps of a carton as the carton moves towards downstream end D. Zone 25 also includes a turntable, a closure plough for the trailing bottom minor flap and closure means for the top minor flaps to be described later.

Glueing station 27 has an upper and a lower applicator head located adjacent ploughs 42, 43 whereby, as the carton moves through the plough a bonding agent is applied to the top minor flaps and the major flaps are brought into position against them. Sealed cartons exit from the apparatus on outfeed means 29. Means 39 may consist of rollers or a conveyor which may be driven if desired.

FIG. 3 shows a detailed perspective view of the upstream end of the apparatus and the collating zone 23. Infeed conveyor 21 extends from end U into zone 23. A stop arm 45 normally projects across a downstream end of zone 23 and it is against this stop that containers 22 are collated. Zone 23 includes two side row forming stops 46, 47 at least one of which is transversely movable. It is between these stops that the rows of containers are collated. Stop arm 45 is movable transversely as shown by arrow 48.

Zone 23 includes a partition 49 which is transversely movable from the position shown (slightly to one side of the flow path of containers) to a position slightly to the other side of the flow path (that is, to the right of FIG. 3) to move a row of containers collated against stop arm 45 to the right against stop 47. Thereafter a further collated row is allowed to accummulate against stop arm 45 and the partition 49 is moved back transversely to the position shown. A further collated row of containers is then allowed to form against stop arm 45. If each collated row has four containers in it, then twelve containers are collated in three rows at the collating zone 23. Sensors 50, 51, 52 count the containers as they progress down the infeed conveyor 21. First and second gates 53, 54 are located along the infeed means. Gate 53 has transversely movable gate members 55, 56 which may move from the full line to the dotted line position. Members 55, 56 enable containers to collate against stop arm 45 and inhibit the flow of containers during movement of partition 49. Gate 54 has a transversely movable member 57 which may be moved into the flow path of containers in the infeed conveyor 21 during movement of the indexing arms 60, 61, 62 (to be described later). Rails 63 extend on opposed sides of the container flow path and assist in guiding the downstream progress of the containers. Gates 53, 54 may be pneumatically driven.

Arms 61, 62 and 63 are termed the downstream, intermediate and upstream arms respectively. The arms 61, 62 and 63 are parallel to one another and connected to a connecting member 64 so that they may move as a unit. Once a series of twelve (say) containers are collated in zone 23 stop arm 45 is withdrawn to the left of FIG. 3. As this occurs arms 61, 62, 63 also move to the left and arm 61 replaces arm 45 and now extends across the downstream end of the collating zone with collated containers located between arms 61 and 62. A further stream of containers then banks up against arm 63 which now extends across the infeed conveyor. The arms 61, 62, 63 then are caused to move longitudinally downstream to index the collated containers and to index containers (over which a carton has been placed) in the packing zone downstream of that zone.

Figure 4:
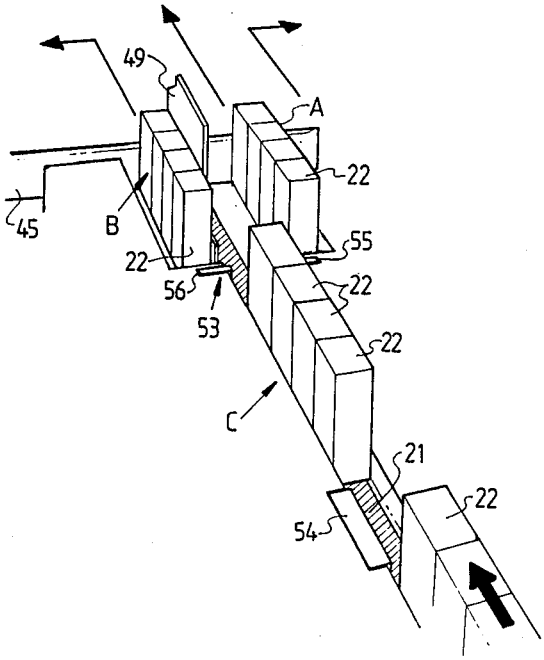
FIG. 4 is a schematic view of a container collating zone downstream of the infeed means.

The way in which containers are collated is shown diagrammatically in FIG. 4. In this figure gate members 55, 56 as well as gate member 57 are shown. Row A is first collated and moved to the position shown by partition 49. Row B is then collated and the partition is then in the position shown. Gate 53 is opened to allow row C to collate against stop arm 45 and gate member 54 prevents further containers from moving downstream until arm 63 (FIG. 3) has moved across infeed conveyor. As indexing arms 61, 62, 63 move downstream gate 54 is opened and at an appropriate time stop arm 45 is returned to the position shown.

Figure 5:
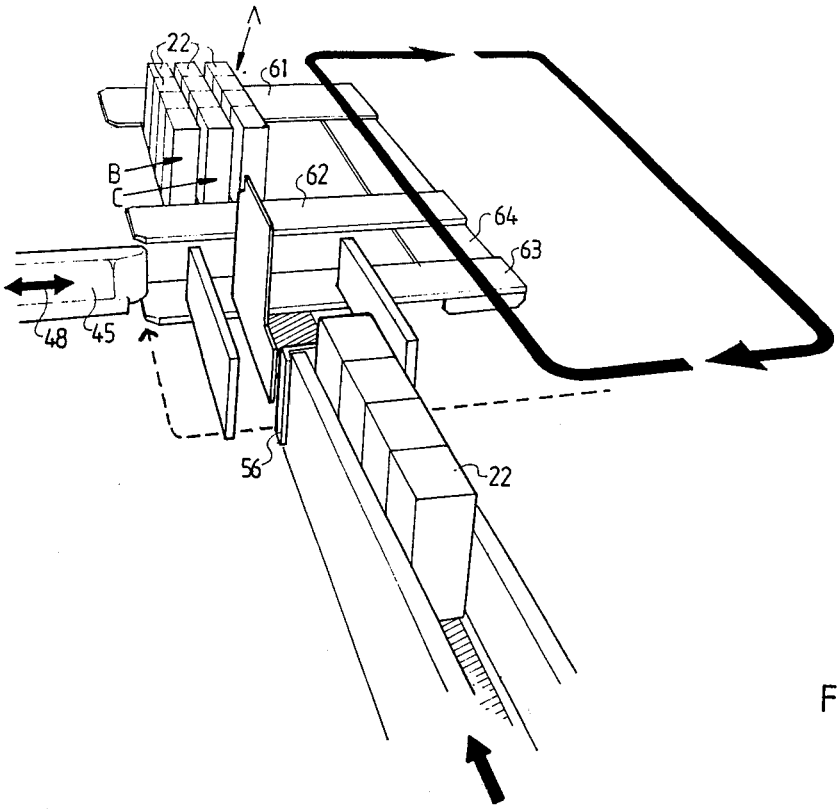
FIG. 5 is a schematic view of a container indexing means of the apparatus of FIG. 2.

In FIG. 5 the indexing operation is shown. Indexing rows A, B and C commences with movement of stop arm 45 along direction of arrow 48. During this movement arm 61, 62, 63 move transversely and arm 61 assumes a position across the downstream end of the collating zone (previously occupied by arm 45). Collated rows A, B and C locate within arms 61, 62 whilst arm 63 locates downstream of gate member 57. The arms 61, 62, 63 then move longitudinally (i.e. downstream) until rows A,B and C are in the packing zone 27 and any carton (with containers within it) in the packing zone is moved downstream. The limit of movement of arms 61, 62, 63 in the downstream direction is such until arm 63 is co-linear with stop arm 45. Further containers 22 may be released by gate members 55, 56 and arm 45 moves transversely across the flow path and arms 61, 62, 63 move transversely (to the right of FIG. 5) out of the flow path and then moved longitudinally to return to the position of FIG. 3. The collating and indexing process described above may then be repeated.

Figure 6:
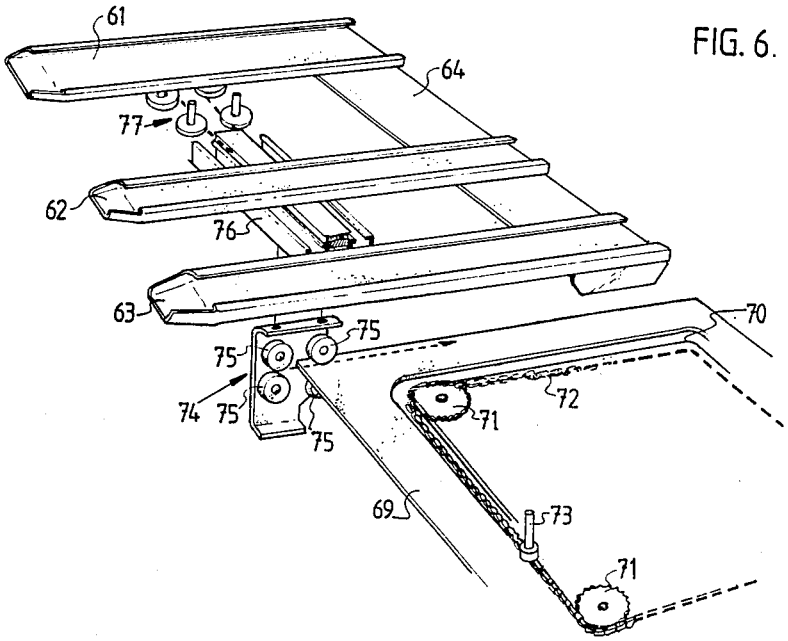
FIG. 6 is a detailed view of the indexing means of FIG. 5.

FIG. 6 shows details of the way in which arms 61, 62, 63 may be driven. A plate 69 with a rectangular or square slot 70 is fixed to a frame of the apparatus and has four sprockets 71 (only two are shown) relative to which a chain 72 is driven. The chain carries a dog or projection 73. The plate has mounted to it a plurality of carriers 74 provided with rollers 75. Carriers 74 enable arms 61, 62, 63 to move transversely of the apparatus as the projection moves along the transverse lengths of travel of chain 72.

Carriers 74 have a longitudinally extending track 76 mounted thereto relative to which the arms 61, 62, 63 move when projection 73 moves along longitudinal paths of the chain. This movement is assisted by rollers 77 which mounted to the arms and which locate relative to the track 76.

Figure 7:
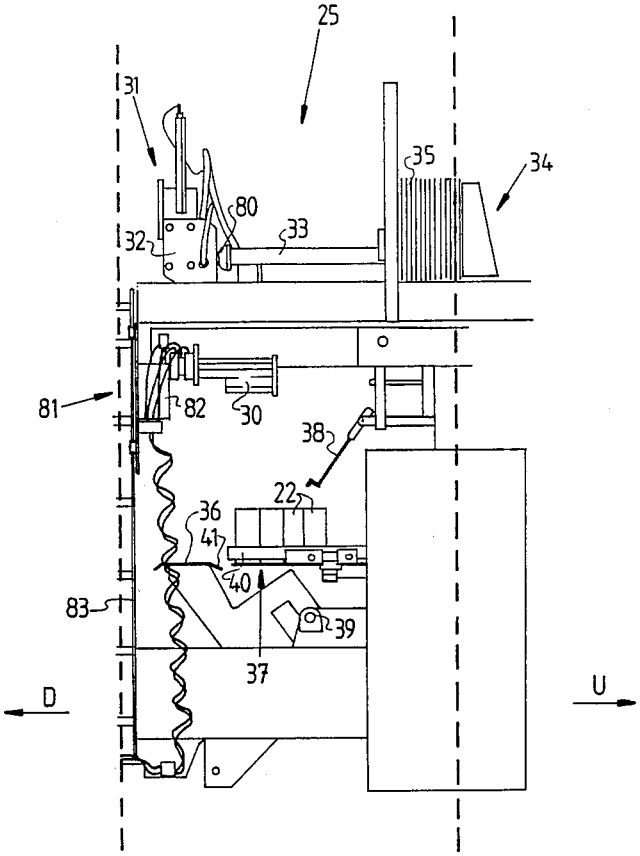
FIG. 7 is a view of a carton erector and carton positioning means.

The positioning zone 25 is shown in greater detail in FIG. 7. Auxillary table 36 is shown in its upper position level with packing table 37. Rows of collated containers 22 have just been indexed onto table 37 whilst a packed carton has been transported downstream and table 36 has returned to its upper position. Erector head 32 is movable towards supply 34 to enable suction caps 80 to remove a carton 35 from the supply 34. As the head returns to the position shown the carton positioner 81 which carries the grippers 30 is in its upper position ready to accept a carton from the erector head 32. This is shown in FIG. 9 in which the erector head 32 has moved down towards the grippers 30.

The positioner 81 has a carriage 82 (see FIG. 8) which bridges between two transversely spaced slide rails 83, 84 relative to which the carriage 82 may move vertically. As the carriage 82 moves down after grippers 30 have grasped major bottom flaps of the carton and suction from cups 80 have been released table 36 is pivoted downwardly to provide clearance for the movement of the grippers 30. Grippers 30 pass between the containers 22 and members 40. Members 40 close against the containers and then open to allow for this to occur. Once the carton is in this position and before the grippers release the carton members 40 close to hold the carton against the containers. Grippers 30 may then release and carriage 82 is caused to return to its upper position.

Figure 10:
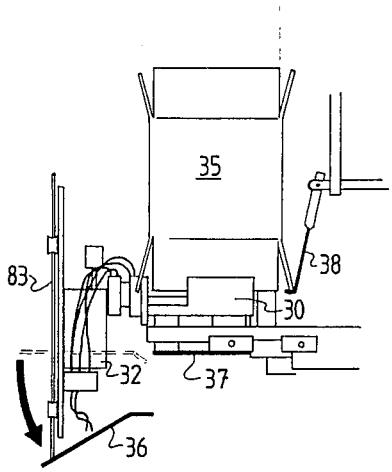
FIG. 10 is a view showing a carton being positioned over containers.
Figure 11:
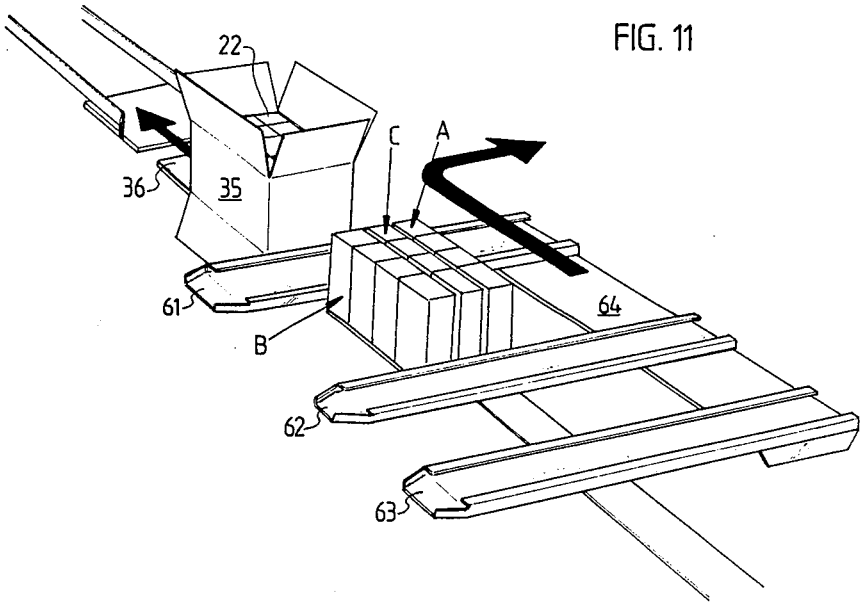
FIG. 11 is a schematic view showing the progression of containers through part of the apparatus of FIG. 2.

As shown in FIG. 10, during the downward movement of carriage 82 table 36 pivots to the full line position. The bottom minor flap engages the knee in member 38 and continued downward movement causes that flap to extend outwardly at right angles and locate flat against table 37. The bottom leading minor flap extends downwardly between and in the gap provided between table 36, 37. The carton may then be transported onto the table 36 during indexing of collated containers by arms 61, 62, 63 as shown in FIG. 11.

This transportation causes the leading bottom minor flap to be folded against the containers within the carton and the members 40 may then be released.

Figure 8:
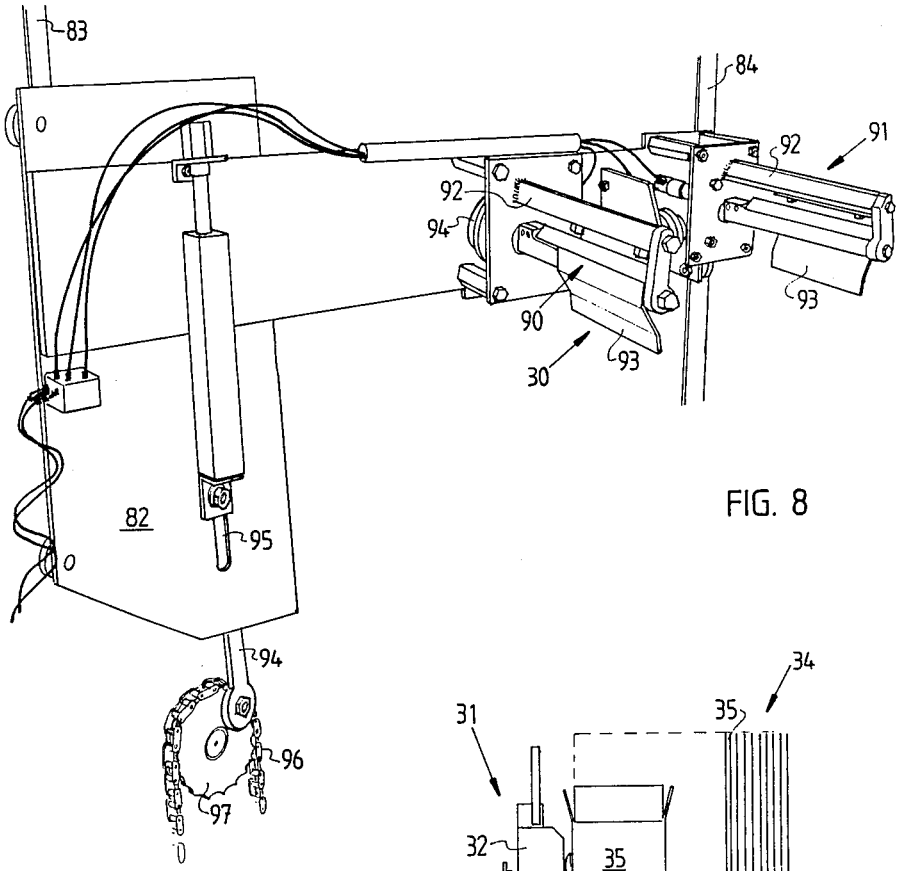
FIG. 8 is a detailed view of the carton positioning means of FIG. 7.

Further details of the carton positioner are shown in FIG. 8. The grippers consist of two spaced pairs of fingers 90, 91. Each pair has a stationary finger 92 and a pivotal finger 93. Fingers 93 are driven by actuators 94 from the position shown against an inner edge of respective fingers 92. Thus a bottom major flap is gripped between each pair of fingers. The left hand finger 93 pivots anticlockwise whilst the other pivots clockwise. Carriage 82 is vertically reciprocated relative to slides 83, 84 by a connecting rod 94. Rod 94 is adjustably received within slot 95 in the carriage 82 whereby the extent of reciprocal movement may be adjusted. This is useful in adapting the apparatus for cartons of various heights. Rod 94 is mounted relative to chain 96 which is driven to run around two vertically spaced sprockets 97 (only one is shown).

Figure 12:
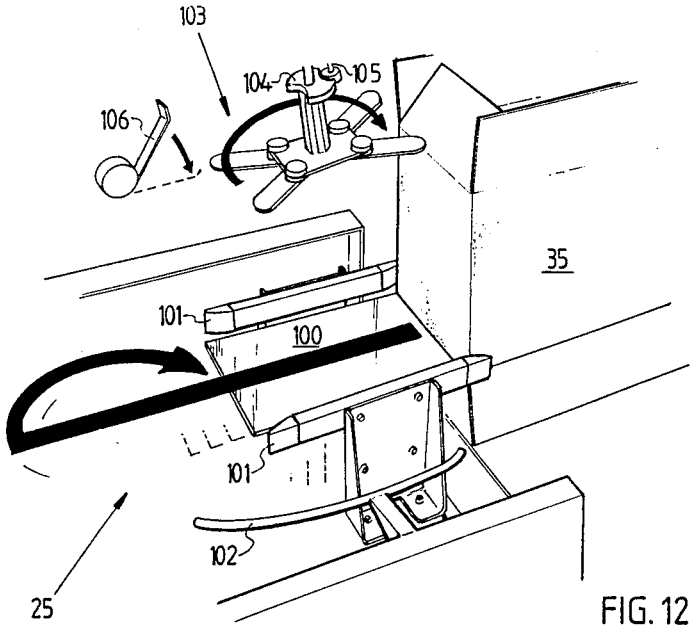
FIG. 12 is a schematic view of a turntable for rotating a carton to enable closure of bottom closure flaps.
Figure 13:
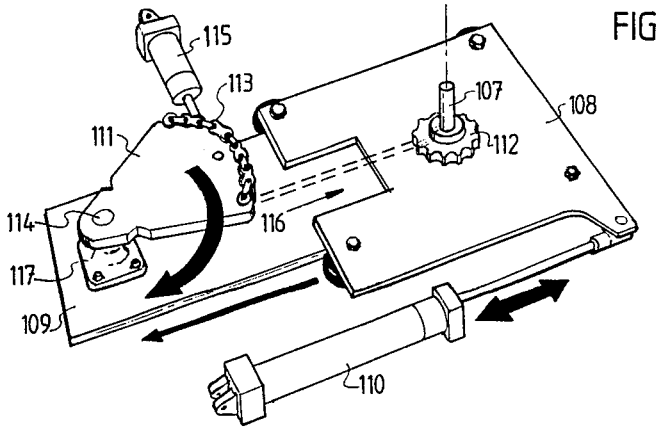
FIG. 13 is a schematic view of the turntable shown in FIG. 12.

FIGS. 12 and 13 show part of a flap closure station 25 for closing top and bottom flaps. A turntable 100 (which is located downstream of table 36) receives a carton from table 36. Turntable 100 has side guides 101. Adjacent one side of turntable 100 an arcuate plough 102 is mounted. As turntable 100 rotates clockwise through 180 degrees the bottom minor trailing flap (which previously extended out at right angles to the carton 35) is folded to extend downwardly and, once the carton is rotated, becomes the leading bottom minor flap. As the carton 35 is transported onto the turntable 100 cross shaped member 103 which has a cam 104 and follower 105 and is inclined with its upstream end higher than its downstream end engages the top leading minor flap and folds it flat. The member 103 rotates as the carton rotates because it is held within the confines of the top major flaps. The cam 104 and follower 105 ensure that member 103 has two preferred positions 180 degrees from each other. Once the container has been rotated the top minor trailing flap now becomes the leading minor flap. This flap is engaged by lever 106 and is folded flat. Lever 106 is periodically actuated for this purpose. If desired the bottom major flaps may be held during rotation of the turntable 100. In this way the speed and hence the throughput capacity of the apparatus may be increased.

The turntable is journalled about spindle 107 as shown in FIG. 13. The turntable 100 is mounted relative to carriage 108 which is longitudinally movable relative to stationary support 109 by a cylinder 110. Carriage 108 is in the position shown to enable the turntable 100 to receive a carton and is retracted against triangular member 111 for rotation of the turntable 100. Carriage 108 carries a sprocket 112 which may engage the arcuate periphery of member 111. This periphery is provided with a rack 113 with which sprocket 112 engages. Member 111 is pivoted about axis 114 by cylinder 115 and when sprocket 112 is in engagement with rack 113 the turntable 100 is caused to rotate. Carriage 108 is slotted at 116 to accommodate bearing block 117 during reciprocal movement of the carriage.

Figure 14:
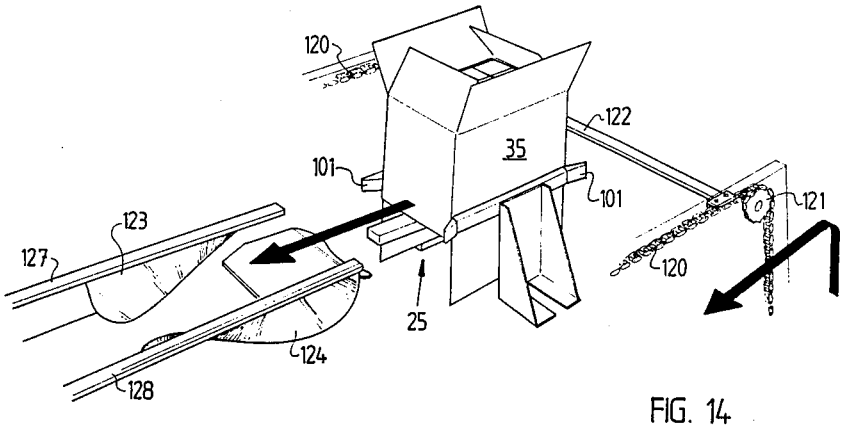
FIG. 14 is a view of transport means downstream of the turntable of FIG. 13; and, FIG. 15 is a view of a carton sealing station.
Figure 15:
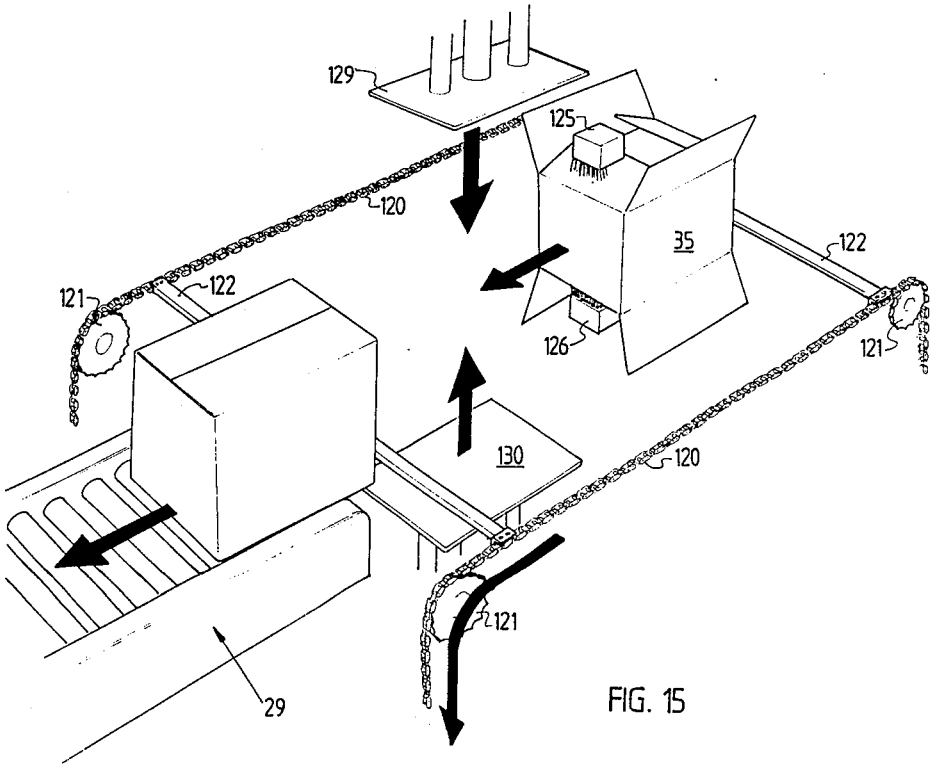

FIGS. 14 and 15 shows the manner in which a carton may be transported through the closure and glueing zones. Arranged either side of the turntable are chains 120 which each run around four sprockets 121. The sprockets are all in vertical planes and one on each side of the apparatus may be driven. Flight bars 122 extend between the chains 220 and at spaced intervals therealong. Once the turntable has been moved downstream by cylinder 110 (FIG. 13) and rotated the chains may be driven to cause flight bars 122 to transport the carton 35 downstream. Closure ploughs 123, 124 are operative to close the bottom major flaps of the carton. A similar pair of ploughs is arranged above ploughs 123, 124 and functions to close the top major flaps. These ploughs have been omitted for the sake of clarity. Prior to the movement of the carton 35 through ploughs 123, 124 it moves past glue heads 125, 126 which apply glue to the minor flaps. The carton after passing through ploughs 123, 124 is supported on rails 127, 128 and between those rails and rails which carry the upper ploughs (not shown). Whilst supported between these rails pressure members 129, 130 are moved to press the major flaps against the minor flaps to seal the carton. Sealed cartons then exit on outfeed 29.

The apparatus of the invention enables containers to be placed within a carton and for the carton to be sealed without human intervention. The operation of the carton is such that the direction of flow path of containers through the apparatus is in a substantial longitudinal direction therethrough.

We claim:

1. A carton over product packaging apparatus including infeed means for conveying a plurality of containers to be packaged to a collating zone in which the containers are collated into a plurality of rows, container indexing means for moving the containers in the collating zone from that zone to a packaging zone, a carton erector longitudinally reciprocably movable and adjacent and above the packing zone, said erector removing a carton from a carton supply station and erecting the carton, positioning means vertically reciprocably movable for receiving a carton from said erector and placing it over containers located in the packing zone, carton closure means downstream of the packing zone and including a turntable for receiving cartons from the packing zone and for rotating them through 180 degrees, said closure means including flap closure ploughs for closing top and bottom closure flaps of the carton, said containers progressing longitudinally through the apparatus from an upstream to a downstream end thereof.

2. The apparatus of claim 1 wherein said infeed means includes an infeed conveyor extending from the upstream end of the apparatus to a downstream end of the collating zone, and two gates at spaced locations along the conveyor movable transversely of the flow of containers through the infeed means, one said gate being adjacent an upstream end of the collating zone, said gates being operable to inhibit the flow of containers towards the collating zone.

3. The apparatus of claim 1 or 2 wherein said collating zone includes two side row forming stops spaced apart from each other and on opposed sides of the collating zone at least one of said forming stops being transversely reciprocably movable, the containers being collated into rows between said forming stops.

4. The apparatus of claim 3 wherein said collating zone includes a downwardly extending partition, said partition being transversely movable to transversely move rows of containers fed to the collating zone towards the side stops.

5. The apparatus of claim 1 including a container stop arm downstream of the collating zone and reciprocably movable between a position withdrawn from the path of flow of containers along the apparatus and a position across the flow path, said stop arm, when extending across the flow path enables rows of containers to collate in the collating zone and when in its withdrawn position enables collated containers to be moved downstream of the apparatus by said indexing means.

6. The apparatus of claim 5 wherein said indexing means includes a plurality of indexing arms transversely and longitudinally movable relative to the apparatus, the arms including a downstream arm, an upstream arm and an intermediate arm adjacent to the upstream arm, said arms being substantially parallel to one another and movable from a first upstream position adjacent to and transversely spaced from the collating zone and infeed means, to a second upstream position where the arms extend across the collating zone and infeed means and across the flow path of containers through the apparatus, to a third downstream position to enable a carton in the packing zone to be transported downstream and collated containers between the downstream arm and intermediate arm to be transported downstream to the packing zone, to a fourth position transversely displaced from the third position and back to said first position.

7. The apparatus of claim 6 wherein said upstream arm, when in the second position prevents further containers supplied by the infeed means from joining the collated containers and enables containers to enter the collating zone as the arms move from the second to the third position.

8. The apparatus of claim 6 wherein said stop arm and said downstream indexing arm are co-linear when said indexing arms are in the first position and as said stop arm is withdrawn said indexing arms move to the second position.

9. The apparatus of claim 6 wherein when said indexing arms are in the third position said upstream indexing arm is co-linear with the stop arm and as said stop arm moves across the container flow path the indexing arms move to the fourth position.

10. The apparatus of claim 1 including two transversely spaced pusher members between which containers collated in the collating zone may pass, said members being spaced at opposed sides of the packing zone and transversely movable towards one another against containers in the packing zone and against the carton placed over the containers whereby the carton may be held as it is transported downstream from the packing zone.

11. The apparatus of claim 1 wherein said packing zone includes a packing table upon which containers may rest.

12. The apparatus of claim 11 including an auxillary table positioned between the packing zone and the turntable, said auxillary table being longitudinally spaced from said packing table to provide a transversely extending gap therebetween, a transversely extending upstream edge of the auxillary table being downwardly angled, said auxillary table being movable between a first position level with the packing table and a second position below the level of the packing table.

13. The apparatus of claim 1 wherein said carton positioning means includes two transversely spaced gripper arms to grip bottom major flaps of a carton, said positioning means being vertically reciprocably movable between an upper position where it receives a carton from the carton erector to a lower position where it positions the carton over containers in the packing zone.

14. The apparatus of claim 13 wherein said gripper arms each include a stationary finger and a movable finger said movable finger being movable towards an associated said stationary finger to thereby grip a carton major closure flap therebetween.

15. The apparatus of claim 1 wherein said carton erector is spaced directly vertically above the flow path of containers through the apparatus.

16. The apparatus of claim 15 wherein said carton erector includes a carton gripping head longitudinally reciprocably movable towards the carton supply and vertically reciprocably movable to present a carton removed from the supply to the carton positioning means.

17. The apparatus of claim 16 wherein the head includes one or more suction caps for gripping and removing a carton from the supply.

18. The apparatus of claim 16 wherein the erector includes an arcuate plough member between the head and the supply whereby as the head moves longitudinally away from the supply after a carton has been removed from the supply, the carton may be drawn across the arcuate plough member and thereby be erected.

19. The apparatus of claim 1 wherein said turntable is longitudinally reciprocably movable towards and away from said packing zone and wherein said turntable is driven to rotate through 180 degrees when spaced from said packing zone.

20. The apparatus of claim 19 wherein said turntable includes grippers for holding major bottom closure flaps of a carton during rotation of the turntable.

21. The apparatus of claim 19 wherein said closure means includes a closure plough adjacent one side of the turntable against which a trailing bottom closure flap may bear during rotation of the carton to thereby partially close that flap.

22. The apparatus of claim 19 wherein said closure means includes a top leading minor flap closure member against which that flap may abut as the carton is moved onto the turntable.

23. The apparatus of claim 22 wherein the top closure member comprises an inclined cross shaped element downwardly extending towards the turntable and mounted for rotation with a carton on the turntable.

24. The apparatus of claim 19 wherein the closure means includes a top closure lever mounted above and downstream of the turntable for closing the remaining top minor flap after the carton has been rotated.

25. The apparatus of claim 19 wherein said closure means includes a top pair of transversely spaced closure ploughs and a bottom pair of transversely spaced closure ploughs being located downstream of the turntable and being adapted to close top and bottom major closure flaps of a carton.

26. The apparatus of claim 25 including bonding agent applicators adjacent said pairs of ploughs for applying a bonding agent to said top and bottom minor flaps before the top and bottom major flaps are closed by the pairs of closure ploughs.

27. The apparatus of claim 25 including top and bottom pressure pads arranged downstream of the applicators and movable towards a carton located between them for pressing the major flaps against the minor flaps to effect a good bond between said flaps.

28. The apparatus of claim 19 including transport means for transporting cartons from the turntable to a downstream end of the apparatus.

29. The apparatus of claim 28 wherein said transport means includes two transversely spaced chains or belts with a plurality of flight bars extending between them whereby said bars are caused to move longitudinally of the apparatus as the chains are driven.

30. The apparatus of claim 29 wherein each chain is driven over two pairs of sprockets, the sprockets being arranged in an upper pair and a lower pair at a transverse location relative to the flow path.

* * * * *